US007337059B2

(12) United States Patent
Pfaeffle et al.

(10) Patent No.: US 7,337,059 B2
(45) Date of Patent: Feb. 26, 2008

(54) METHOD AND DEVICE FOR OPERATING AN INTERNAL COMBUSTION ENGINE

(75) Inventors: Andreas Pfaeffle, Wuestenrot (DE); Stefan Polach, Stuttgart (DE); Dietmar Stapel, Korntal-Münchingen (DE); Oliver Brox, Kortal-Münchingen (DE); Matthias Wild, Schönaich (DE)

(73) Assignee: Robert Bosch GmbH, Stuttgart (DE)

( * ) Notice: Subject to any disclaimer, the term of this patent is extended or adjusted under 35 U.S.C. 154(b) by 61 days.

(21) Appl. No.: 11/331,306

(22) Filed: Jan. 11, 2006

(65) Prior Publication Data

US 2006/0173605 A1 Aug. 3, 2006

(30) Foreign Application Priority Data

Jan. 17, 2005 (DE) ..... 10 2005 002 111

(51) Int. Cl.
*F02D 41/30* (2006.01)

(52) U.S. Cl. ..... 701/104; 123/299; 60/285

(58) Field of Classification Search ..... 701/104, 701/111; 123/299; 60/274, 285, 295, 297
See application file for complete search history.

(56) References Cited

U.S. PATENT DOCUMENTS 6,161,530 A * 12/2000 Kakizaki et al. ..... 123/674
6,578,546 B2 * 6/2003 Schultalbers et al. ..... 123/300
6,591,818 B2 * 7/2003 Sasaki et al. ..... 123/568.12
6,778,883 B1 * 8/2004 Gerhardt et al. ..... 701/1
6,832,150 B2 * 12/2004 Higashiyama et al. ..... 701/105
6,993,901 B2 * 2/2006 Shirakawa ..... 60/295

* cited by examiner

*Primary Examiner*—Willis R. Wolfe
*Assistant Examiner*—Johnny H. Hoang
(74) *Attorney, Agent, or Firm*—Kenyon & Kenyon LLP

(57) ABSTRACT

A method and a device for controlling an internal combustion engine. In a first operating mode, a fuel quantity is predefined according to a first rule for calculating the quantity based on at least the torque variable. In a second operating mode, the fuel quantity is predefined according to a second rule for calculating the quantity based on at least the torque variable. A control variable is predefined on the basis of at least the torque variable.

6 Claims, 1 Drawing Sheet

METHOD AND DEVICE FOR OPERATING AN INTERNAL COMBUSTION ENGINE

FIELD OF THE INVENTION

The present invention relates to a method and a device for controlling an internal combustion engine, in particular an internal combustion engine having direct injection.

BACKGROUND INFORMATION

Methods and devices for controlling an internal combustion engine ascertain the desired torque on the basis of the driver input and convert it into a fuel quantity to be injected. Preferably, a fuel quantity to be injected during an injection cycle is specified in the process. This fuel quantity and the engine torque define the operating point of the engine. From this, additional variables such as air mass setpoint values are calculated. This means that these inputs or family of characteristics must likewise be provided for different operating modes.

The fuel quantity resulting in this conversion exclusively relates to a specific operating mode of the engine. In one operating mode, in a diesel engine, for instance, this is lean-combustion operation with conventional diesel combustion, or the regeneration operation for scavenging a particle filter. The operating modes differ considerably in their efficiency and thus in the fuel quantity to be injected in the same operating point. This worsening of the efficiency is attributable to the fact that in the regeneration fuel is injected in an angular range that renders only a negligible or no contribution to the overall torque. In order to achieve the desired torque, the fuel quantity may therefore have to be corrected. As a result, the conversion of torque into fuel quantity can no longer be used for the unambiguous definition of the engine operating point.

This means that for each operating mode a different calculation rule or different parameters must be used to calculate the fuel quantity on the basis of the torque. This considerably complicates the application of the variables as a function of the operating point.

Since the variables as a function of the operating point differ between different operating modes, a transition function must ensure the continuous transition during the switchover between the operating modes. The variables to be switched are usually ramped to the new value. The same applies to the fuel quantity. Since the fuel quantity reference variable and the setpoint values are ramped simultaneously, the profile of the setpoint values during the switchover is unpredictable. Consequently, the application of the operating mode transitions is not possible.

SUMMARY OF THE INVENTION

According to the present invention, the additional control variables will be ascertained on the basis of at least the torque variable, i.e., the input variable in the conversion of torque into fuel quantity. The fuel quantity and the control variable are calculated on the basis of the torque variable. The fuel quantity in individual operating modes is ascertained in different ways. In one development it may also be provided that the control variables are likewise calculated in a different manner in individual operating modes. In another development additional control variables are ascertained on the basis of the fuel quantity. This ascertainment of the additional control variables generally differs in individual operating modes.

DETAILED DESCRIPTION

Figure 1:
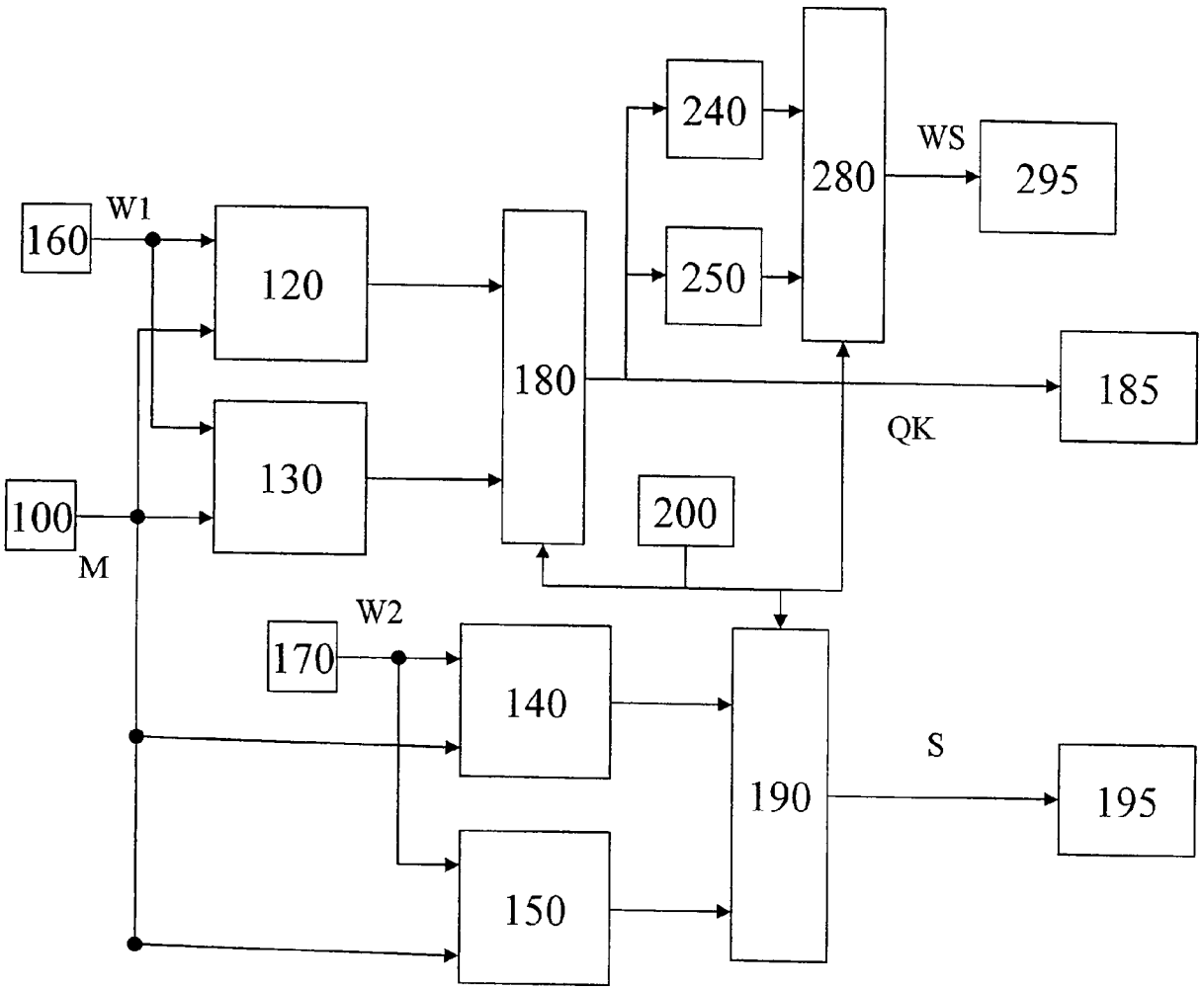
FIG. 1 shows a block diagram of the procedure according to the present invention.

In FIG. 1, the procedure of the present invention is described using the example of an internal combustion engine having self-ignition. The procedure according to the present invention is not limited to such an internal combustion engine, but may be utilized for various internal combustion engines when the task includes predefining a fuel quantity to be injected or defining additional control variables on the basis of the desired torque. This specifically applies to all directly-injecting internal combustion engines and to internal combustion engines having self-ignition.

A torque setpoint selection is denoted by 100 in the FIGURE. This torque setpoint selection applies a signal M, which characterizes the desired torque, to a first input 120, a second input 130, a third input 140, and a fourth input 150. A signal input 160 applies an additional variable W1 to first input 120 and second input 130. Analogously, a signal input 170 applies an additional variable W2 to third input 140 and fourth input 150.

Via a first changeover switch 180, the output signals of first input 120 and second input 130 arrive as fuel quantity variable QK at a quantity controller 185. Via a second changeover switch 190, the output signals of third input 140 and fourth input 150 arrive as control variable S at an actuator 195.

Output signal QK of first changeover switch 180 also arrives at a fifth input 240 and a sixth input 250. Via a third changeover switch 280, the output signals of the fifth and sixth input reach an additional actuator 295 as additional control variable WS.

An operating mode coordinator 200 applies control signals to first changeover switch 180, second changeover switch 190 and third changeover switch 280.

Torque setpoint selection 100 calculates a desired torque M on the basis of the driver input, which is preferably detected by a sensor, and possibly on the basis of additional operating parameters. This desired torque M indicates how much torque the driver is requesting. On the basis of this requested torque M and possibly additional operating parameters W1, first input 120 and second input 130 calculate the required fuel quantity. The individual efficiency is entered in the conversion of torque into quantity as an important variable. The efficiency is defined by the timing of the injection, for instance. If the fuel injection is implemented in advance of or in the region of top dead center, the entire injected fuel quantity will be converted into torque. The efficiency assumes standardized value 1 in this case. If the injection takes place very late after top dead center, the fuel reaches the exhaust system in more or less uncombusted form. In this case the efficiency assumes values that are smaller than 1.

Such a transition of the fuel or the partially converted fuel into the exhaust system is desired specifically in operating states in which the exhaust-gas aftertreatment system is regenerated, for example. Such an exhaust-gas aftertreatment system to be regenerated may include, for example, a particle filter, an oxidation catalyst, a nitrogen oxide catalyst and/or other catalysts. A regeneration operation of this type will be referred to as operating mode in the following.

The first operating mode is usually normal operation during which the fuel is completely converted into torque. A second operating mode may be, for instance, a regeneration operation of a particle filter. First input 120 then implements the conversion of torque into fuel quantity in the first operating mode, and second input 130 carries out the conversion in the second operating mode.

The method according to the present invention is not limited to two operating modes, as illustrated in the figure, but may be expanded to any number of operating modes. In this case, a corresponding number of inputs must be provided, which calculate the fuel quantity on the basis of the torque, as well as inputs that calculate the additional control variable S on the basis of the torque.

In the above example, second operating mode denotes that a regeneration of the exhaust-gas aftertreatment system is carried out. Furthermore, a homogenous or a partially homogenous operation of the diesel gasoline engine is denoted as an operating mode.

In the individual operating mode, first input 120 and second input 130 calculate fuel quantity QK to be injected as a function of torque variable M and additional operating parameters W1. An additional operating parameter that is considered important and entered in the conversion is the efficiency and/or the rotational speed of the internal combustion engine. The different inputs 120 and 130 differ, first of all, in the value the efficiency assumes. As an alternative or in addition, it may be provided that first input 120 and second input 130 use different rules to calculate the fuel quantity to be injected on the basis of the torque. That is to say, given the same input variables, the output variable is calculated in a different manner.

This may be realized, for instance, in that the same input variables are applied to different characteristic maps, i.e., that different relationships of fuel quantities QK and input variables W1 and/or M are used in at least two different operating modes.

In addition, it may be provided that different operating parameters are used as input variables in different operating modes. In particular the air mass, the ratio of fuel quantity and air mass, and/or the exhaust-recirculation rate may be utilized as operating parameters. Instead of these variables, this variable, too, may be utilized in characterizing variables.

Furthermore, it may be provided that the first and the second input use different characteristic maps and different input variables, i.e., that different rules are used to ascertain the fuel quantity variable in at least two different operating modes.

Changeover switch 180 then selects the appropriate output signal of the corresponding input as a function of the actual operating mode and forwards it to quantity controller 185.

An analogous procedure is used when determining control variable S. Third and fourth input 140 and 150, respectively, calculate control variable S in the individual operating mode as a function of torque variable M and additional operating parameters W2. Another operating parameter that is considered important and entered in the conversion is the rotational speed of the internal combustion engine, for instance.

If control variable S does not depend on the operating mode, an advantageous development may provide that only one input be provided for determining the control variable. Changeover switch 190 may be omitted in this case.

The different inputs 140 and 150 differ in the rules by which control variable S is calculated on the basis of the torque. That is to say, given the same input variables, the output variable is calculated in a different manner.

This may be realized, for instance, in that the same input variables are applied to different characteristic maps, i.e., different relationships of the actuating variable and input variables W2 and/or M are used in at least two different operating modes.

In addition, different operating parameters may be used as input variables in different operating modes. In particular the air mass, the ratio of fuel quantity and air mass, and/or the exhaust-recirculation rate may be utilized as operating parameters. Instead of these variables, this variable, too, may be utilized in characterizing variables.

Furthermore, it may be provided that the first and the second input use different characteristic maps and different input variables, i.e., that different rules are used in at least two different operating modes.

Changeover switch 190 then selects the appropriate output signal of the corresponding input as a function of the actual operating mode and forwards it to quantity controller 195.

It is important here that control variable S is calculated on the basis of torque M, which is also used to calculate fuel quantity QK, and additional variables W2. This means that control variable S is calculated as a function of the operating point of the internal combustion engine. The operating point is defined by torque M and possibly additional variable W2. The operating point is preferably defined by the torque and rotational speed. The torque indicates the driver input. The driver input may be corrected and/or influenced by additional control units. Torque M indicates which torque the internal combustion engine is to provide.

If control variable S is independent of the operating mode, only one procedure for determining the control variable will be required. If the control variable is a function of the operating mode, an input for each operating mode will be necessary; however, since the control variable is independent of the efficiency of the individual operating mode, the advantage results that the operating modes may be applied independently of one another, i.e., the application of the operating modes is simplified considerably.

This means that the fuel quantity in a first operating mode is predefined according to a first rule for calculating the quantity on the basis of at least one torque variable; in a second operating mode, the fuel quantity is predefined according to a second rule for calculating the quantity on the basis of at least the torque variable; a first control variable is predefined on the basis of at least the torque variable. In a development, it may also be provided that the control variable is predefined according to a first rule for calculating the control variable in the first operating mode, and in the second operating mode it is predefined according to a second rule for calculating the control variable.

On the basis of at least the torque variable, both the fuel quantity and the control variable are then determined. For each operating mode a different method is provided according to which the fuel quantity or the control variable will be ascertained. In addition to the torque variable, other variables may be utilized as well, it being possible to provide different additional variables for the fuel quantity and the control variable. It is also possible to use different additional variables in different operating modes.

In particular, the procedure according to the present invention is used with control variables S that depend only on the operating point of the internal combustion engine or influence it. These are, in particular, control variables influencing the start of the injection or the air quantity supplied to the internal combustion engine, the recirculated exhaust-gas quantity, the charge pressure or the swirl. If the injection is distributed to a plurality of partial injections, the onsets of all partial injections as a function of torque are preferably defined as a control variable.

Additional control variables WS that are essentially defined by the fuel quantity are not predefined as a function of the torque variable, but as a function of the fuel quantity, i.e., the output signal of changeover switch 180. These are actuating variables, for instance, that ensure smoke limitation, engine protection and limitations in the high-pressure control. In the first operating mode, this second control variable is predefined according to a third rule for calculating the second control variable on the basis of at least the fuel quantity, and in the second operating mode it is predefined according to a fourth rule for calculating the second control variable.

What is claimed is:

1. A method for controlling an internal combustion engine, comprising:

predefining a fuel quantity in a first operating mode according to a first rule for calculating the quantity on the basis of at least a torque variable;

predefining the fuel quantity in a second operating mode according to a second rule for calculating the quantity on the basis of at least the torque variable; and predefining a control variable on the basis of at least the torque variable.

2. The method according to claim 1, wherein in the first operating mode the control variable is predefined according to a first rule for calculating the control variable on the basis of at least the torque variable, and in the second operating mode the control variable is predefined according to a second rule for calculating the control variable.

3. The method according to claim 1, wherein in the first operating mode, an additional control variable is predefined according to a third rule for calculating the additional control variable on the basis of at least the fuel quantity, and in the second operating mode the additional control variable is predefined according to a fourth rule for calculating the additional control variable.

4. The method according to claim 1, wherein the control variable is a function of an operating point of the internal combustion engine.

5. The method according to claim 4, wherein the operating point of the internal combustion engine is defined by at least a driver input.

6. A device for controlling an internal combustion engine, comprising:

a first input arrangement for predefining, in a first operating mode, a fuel quantity according to a first rule for calculating the quantity on the basis of at least a torque variable;

a second input arrangement for predefining, in a second operating mode, the fuel quantity according to a second rule for calculating the quantity on the basis of at least the torque variable; and a third input arrangement for predefining a control variable on the basis of at least the torque variable.

* * * * *